United States Patent [19]

Hümüller et al.

[11] 4,153,561

[45] May 8, 1979

[54] CONDITIONING AGENT

[75] Inventors: Edwin Hümüller, Hofheim am Taunus; Karl-Heinz Keil; Joachim Ribka, both of Offenbach am Main, all of Fed. Rep. of Germany

[73] Assignee: Hoechst Aktiengesellschaft, Frankfurt am Main, Fed. Rep. of Germany

[21] Appl. No.: 865,612

[22] Filed: Dec. 29, 1977

[30] Foreign Application Priority Data

Dec. 31, 1976 [DE] Fed. Rep. of Germany ..... 2659696
May 25, 1977 [DE] Fed. Rep. of Germany ..... 2723525

[51] Int. Cl.[2] ..... D06M 13/40
[52] U.S. Cl. ..... 252/8.75; 252/8.7; 252/8.8; 252/8.9
[58] Field of Search ..... 252/8.75, 8.7, 8.9, 252/8.8

[56] References Cited

U.S. PATENT DOCUMENTS

| | | | |
|---|---|---|---|
| 2,427,242 | 9/1947 | Vitalis et al. | 252/8.75 |
| 2,740,759 | 4/1956 | Maeder et al. | 252/8.7 |
| 3,101,323 | 8/1963 | Merlo et al. | 252/8.9 |
| 3,649,535 | 3/1972 | Clark et al. | 252/8.75 |
| 3,803,036 | 4/1974 | Sunby et al. | 252/8.75 |

*Primary Examiner*—William E. Schulz
*Attorney, Agent, or Firm*—Connolly and Hutz

[57] ABSTRACT

Compositions in the form of aqueous emulsions containing salts of N-alkyl-α-sulfosuccinic acid amides, fatty acid amide sulfates or glycerin ether derivatives, polyethylene glycols and non-ionic dispersing agents. These emulsions are very stable to storage. They are used for the treatment of textile materials. Preferably they are added to the padding liquor in continous pad-dyeing or printing processes for textiles including carpets of synthetic fibers. They can also be used in space-dyeing processes. They give a soft feel to the textiles treated therewith and also provide a good wetting of the textile goods. On synthetic fibers also an anti-soiling effect has been observed.

2 Claims, No Drawings

CONDITIONING AGENT

It is generally known to submit textile material to a conditioning treatment by suitable compounds, thus imparting a soft handle to the textile material. Care should be taken that the textile material does not lose its capability of being rewetted by aqueous baths by such a treatment. Conditioning agents are already known containing as softening component the conventional agents for improving the handle, for example tetralkylammonium compounds in combination with usual wetting agents, for example alkylsulfuric acid esters, alkanesulfates, alkylarylsulfates and alkanesulfonates. Owing to the opposed electrical charges of these conditioning agents and wetting agents, stable emulsions or dispersions thereof, which are absolutely necessary for a single bath application, can be prepared only with difficulty. When using simultaneously commercial conditioning agents and wetting agents, the rewettability of the textile material, certainly, is improved to a certain degree, but handle is scarcely influenced.

The same is applicable to the N-alkyl-α-sulfo-succinamide acids or their salts, which have been proposed as textile softeners in U.S. Pat. No. 2,427,242. When using these compounds, a sufficient rewettability of the textile material upon conditioning them can be obtained only when adding conventional wetting agents in such a high amount that the properties of the N-alkyl-α-sulfosuccinamide acids imparting an improved handle to textile material are conteracted. Moreover emulsions or dispersions of these types of compounds are not sufficiently storable. The present invention, consequently, was confronted with the problem of developing conditioning agents which should be storable and sufficiently rewettable without defavorably affecting the conditioning effect.

It has now been found that these requirements are fulfilled by mixtures containing, in addition to salts of N-alkyl-α-sulfosuccinamide acids, fatty acid amide sulfates, wax-like polyethylene glycols and non ionic dispersing agents. The present invention, consequently, provides conditioning agents in the form of aqueous emulsions containing (a) of from 5 to 20, preferably 5 to 15, % by weight, of a compound of the formula I

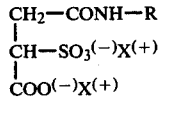

I wherein R is a branched or linear alkyl or alkylene group having of from 10 to 30, preferably of from 12 to 20, carbon atoms or a group of the formula R'—N-H—$(CH_2)_n$—, n is an integer of from 2 to 4, X is a sodium, potassium or ammonium ion and R' is defined as R;

(b) of from 2 to 20, preferably of from 3 to 15, % by weight, of a fatty acid amide sulfate of the formula II

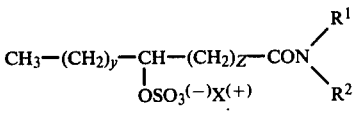

II wherein $R^1$ and $R^2$ each is an alkyl group having of from 1 to 5 carbon atoms or $R^1$ is a hydrogen atom and $R^2$ is a $C_{1-8}$ alkyl, phenyl or $C_{1-4}$ alkylphenyl group, Y and Z each is an integer of from 6 to 8, preferably represent together 14, and X is defined as in formula I or, of from 2 to 20% by weight of a glycerine ether derivative of the formula III

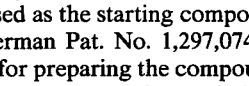

III wherein $R^1$ and $R^2$ represent identical or different, branched or linear $C_{4-8}$alkyl groups, preferably branched $C_8$alkyl groups, Y is zero or an integer of from 1 to 4 and Z is a group of the formulae —$(CH_2)_n$—COOMe, —$SO_3$Me or —$PO_3Me_3$, n is 1, 2 or 3 and Me is an alkali metal, ammonium or trialkylammonium ion;

(c) of from 1 to 15, preferably of from 1 to 3, % by weight, of a polyethylene glycol of the formula IV $$HO(CH_2CH_2O)_mH \qquad IV$$

wherein m is an integer of from 100 to 400, preferably of from 100 to 250 and (d) of from 1 to 5, preferably of from 1 to 3, % by weight of a non-ionic ethylene oxide addition product, as emulsifier.

The compounds of the formula I have been proposed in U.S. Pat. No. 2,427,242 and in J.Am.Oil Chem.Soc. 51 (1974), 7, pages 297 to 301. They may be obtained by reacting maleic acid anhydride with a long chain amine and by subsequently adding sodium pyrosulfite. Suitable long chain amines are those having the above-indicated number of carbon atoms, in particular those having an alkyl chain which is derived from natural fatty acids, for example stearylamine, palmitylamine, oleylamine or from natural mixtures of fatty acids, for example tallow fatty amine or coconut fatty amine.

The fatty acid amide sulfates of the formula II may be obtained by converting long chain unsaturated fatty acids into the corresponding acid chloride, by reacting the product obtained with the amine and sulfating the double bond. (Cf. Lindner, Tenside-Textilhilfsmittel-Waschrohstoffe, volume I, page 365; German Pats. Nos. 1,297,074; 634,032; 695,173; 679,731; 671,085). These products may contain more or less high quantities of the corresponding unsulfated fatty acid amide, of the free fatty acid used as the starting compound and of mineral salts (cf. German Pat. No. 1,297,074), which is due to the process for preparing the compounds of the formula II. A suitable unsaturated fatty acid is in particular oleic acid. The amines either contain two alkyl groups having of from 1 to 5 carbon atoms, preferably linear groups, or a $C_{1-8}$alkyl group, a phenyl group or a $C_{1-4}$alkylphenyl group.

The glycerine ether derivatives of the formula III may be obtained by reacting 1,3-dialkoxypropanols-2 or their ethoxylation products with ω-halogenalkane-carboxylic acids, -sulfonic acids or -phosphonic acids according to German patent specification 12 56 640 or by esterifying the ethoxylation products of 1,3-dialkoxypropanols with sulfuric- or phosphoric acid (cf. German Offenlegungsschrift No. 2,139,448). The sum of the carbon atoms contained in the radicals $R^1$ and $R^2$ for the glycerine ether derivatives of the formula III should preferably be in the range of from 10 to 16.

The polyethylene glycols of the formula IV are commercial waxes which preferably have a molecular weight in the range of from 4,000 to 10,000, corresponding to n = 100 to 250. As the fourth component the conditioning agents according to the invention contain emulsifiers based on ethylene oxide addition products of long chain alcohols ($C_{12-20}$) or $C_{4-9}$alkylphenols, preferably nonylphenol. The degree of ethoxylation generally is in the range of from 20 to 80, preferably of from 20 to 30, units of ethylene oxide per OH group.

The conditioning agent according to the invention may be prepared by simply mixing the individual components in water by stirring.

In order to assure a good stability of the conditioning agent, however, the components (b) to (c) are preferably added to a hot aqueous solution of the component (a) or, as it is disclosed in the examples, the components (b) to (c) are added during the preparation of the component (a). The ready-made conditioning agent is present in the form of an aqueous emulsion containing the individual components in the concentrations indicated hereupon. Its pH is adjusted to a slightly acid value of from 5 to 6 with weak acids, for example acetic acid. The conditioning agent is present in a form capable of being readily poured and can be easily diluted with cold water. Prior to application, this commercial concentrate is further diluted with water to a content of from about 15 to 25 of concentrate per one liter of the liquor.

The above-described conditioning agent imparts to textile material of synthetic or natural fibers such as polyester, polyamide or cellulose treated therewith a soft, voluminous and supple handle with simultaneous good wetting. Moreover the textile material treated with the conditioning agent may be readily rewetted. Finally this conditioning agent is very storable.

The following examples illustrate the invention:

EXAMPLE 1

98 g (1 mol) of maleic acid anhydride are dissolved in 60 g (1 mol) of acetic acid while heating to a temperature of from 60° to 70° C. and thereafter 269 g (1 mol) of octadecylamine are added to the solution in a molten state, the reaction temperature being maintained at a range of from 80° to 90° C. by the generated reaction heat. The following acid number was determined for the crude N-octadecylmaleinamide acid:acid number: calculated 152.6; found: 150

The crude N-octadecylmaleinamide acid obtained is added to a mixture of 326.4 g of 27% NaOH in 2736 ml of $H_2O$, 54.72 g of a 4-nonylphenol-25 ethylene oxide addition product, 54.72 g of polyethylene glycol (molar weight of from 5000 to 6000) and 452.1 g of a sodium salt of the sulfuric acid semiester of 10-hydroxy-octadecanoic acid-n-dibutylamide and stirring is continued at 90° C. By adding 103.9 g (0.54 mol) of sodium pyrosulfite in the form of a 50% aqueous solution, the mixture is reacted yielding the sulfosuccinic acid amide. After stirring until completion at a temperature of from 80° to 90° C. the pH is adjusted at a value of from 5 to 6 by glacial acetic acid and the reaction mixture is adjusted to a final content of sulfosuccinic acid amide of 20% with hot water. The finely dispersed emulsion thus obtained shows excellent softening properties and simultaneously has a good storability.

An emulsion which has the same good properties as the above-described is obtained when reacting tallow fatty amine with an average chain distribution of from $C_{14-16}$ and an average molar weight of 270. The N-tallow fatty alkyl-maleinamide acid prepared according to the above procedure has an acid number of from 150 to 153; the acid number found was 151.

It is also possible to use N-coconut fatty alkylamine (average molar weight of 200) instead of N-octadecylamine.

EXAMPLE 2

98 g (1 mol) of maleic acid anhydride are dissolved in 60 g (1 mol) of glacial acetic acid while heating and 269 g (1 mol) of N-octadecylamine are added to the solution at 80° to 90° C. The N-octadecylmaleinamide acid obtained has an acid number of 151. It is introduced while stirring into a mixture of 326.4 g of 27% NaOH in 2736 ml of $H_2O$, 54.72 g of an addition product of 1 mol of nonylphenol-25-mols-ethylene oxide, 54.72 g of polyethylene glycol having a molar weight of 4000 and 452.1 g of sodium salt of the sulfuric acid semiester of 10-hydroxy-octadecane-n-dimethylamide, at 90° C., and the temperature is maintained at this level. Thereafter there are added 103.9 g (0.54 mol) of sodium pyrosulfite. The emulsion thus obtained is finely dispersed and highly storable.

EXAMPLE 3

147 g (1.5 mols) of maleic acid anhydride are dissolved in 90 g (1.5 mols) of glacial acetic acid while heating to a temperature of from 60° to 70° C. and 403.5 g (1.5 mols) of N-octadecylamine are added to the solution in a way to attain a temperature in the range of from 80° to 90° C. An acid number of 153 was determined for the crude N-octadecylmaleinamide acid (theoretical value 152). The crude N-octadecylmaleinamide acid is introduced by stirring into a mixture of 489.6 g of 27% NaOH in 4104 ml of $H_2O$, 82 g of 4-nonylphenol.25 AeO addition product, 82 g of polyethylene glycol having an average molar weight of 8000 and 678.1 g of the sodium salt of the sulfuric acid semiester of 10-hydroxy-octadecane-n-butyl-ethylamide and the reaction batch is maintained for 3 hours at a temperature of from 80° to 90° C.

A particularly storable emulsion is obtained when subsequently reacting the mixture with 155 g (0.82 mol) of sodiumpyrosulfite.

The following fatty acid amide sulfates may be used in the same way: the sodium salts of the sulfuric acid semiesters of ethylmethylamide of 10-hydroxy-octadecanoic acid, of di-n-propylamide of 10-hydroxy-octadecanoic acid and of n-propyl-isopropylamide of 10-hydroxy-octadecanoic acid.

EXAMPLE 4

196 g (2 mols) of maleic acid anhydride are dissolved in 120 g (2 mols) of glacial acetic acid while heating to a temperature of from 60° to 70° C. and 652 g (2 mols) of N-octadecylpropylene diamine are added to the solution formed in a way to attain a temperature of from 80° to 90° C.

The N-octadecyl-γ-aminopropyl-maleinamide acid obtained is introduced while stirring into a mixture of 652.8 g of 27% NaOH, 109.4 g of 4-nonylphenol.30 AeO addition product, 109.4 g of polyethylene glycol having a molar weight of from 5000 to 6000 and 904.2 g of the sodium salt of the sulfuric acid semiester of 10-hydroxy-octadecanoic acid-dibutylamide and stirring is continued for one hour at 90° C. After reaction with 207.8 g (1.09 mol) of sodium pyrosulfite as 50% aqueous solution to yield the sulfosuccinic acid amide, stirring until room temperature is reached and adjustment with glacial acetic acid to a pH of 5, there is obtained a particularly storable emulsion imparting an excellent feel to textile material. The reaction is observed by iodometric titration of the sulfite content. At the end of the reaction 0.5% of the sulfite quantity charged were still present in the 20% emulsion.

The above-described N-octadecyl-γ-aminopropylmaleinamide acid may alternatively be replaced by the reaction products of N-tallow-fatty alkylpropylene diamine or N-coconut fatty alkylpropylene diamine with maleic anhydride. Thus there are obtained emulsions being equal in quality of the above-described emulsions and imparting to textile material the same handle.

COMPARATIVE EXAMPLES 98 g (1 mol) of maleic anhydride are dissolved in 60 g (1 mol) of glacial acetic acid while heating to a temperature of from 60° to 70° C. and thereafter 269 g (1 mol) of octadecylamine are added to the solution formed in a way to maintain the reaction temperature in a range of from 80° to 90° C. The following acid numbers were found for the crude N-octadecylmaleinamide acid:acid number: calculated: 152.6; acid number: found: 153

The crude N-octadecylmaleinamide acid is introduced into 326.4 g of 27% NaOH of 90% concentration and the mixture is reacted thereafter with 103.9 g (0.54 mol) of sodium pyrosulfite as 50% aqueous solution yielding the sulfosuccinic acid amide. After stirring to room temperature the pH of the reaction product is adjusted to 5 with acetic acid.

The emulsion obtained has practically no absoptive capacity in application technique and only a very low thermal storability (2 to 3 days of storage at 50° C.), whereas the emulsions according to the invention according to Examples 1 to 4 are storable at 50° C. for a period of time of more than 10 days.

98 g (1 mol) of maleic anhydride are dissolved in 60 g (1 mol) of glacial acetic acid while heating and 269 g (1 mol) of octadecylamine are added to the solution in a way to attain a reaction temperature between 80° and 90° C. The crude N-octadecylmaleinamide acid formed has an acid number of 153 (theoretical value 152.6). It is incorporated while stirring into a mixture of 326.4 g of 27% NaOH in 2736 ml of $H_2O$, 54.72 g of 4-nonylphenol.25 AeO addition product, 54.72 g of polyethylene glycol having a molar weight of 6000 and 452.1 g of sodium salt of a $C_{12-18}$alkanesulfonic acid.

The reaction mixture is reacted with 103.9 g (0.54 mol) of sodium pyrosulfite yielding the sulfosuccinic acid amide, thereafter it is cooled to room temperature and its pH is adjusted subsequently to 5 with glacial acetic acid.

The emulsion is adjusted to the same content of active matter as that of the emulsion of the invention. The textile material which has been finished therewith has a considerably worse handle than the emulsions of the above Examples 1 to 4 and the emulsion has only a very low storability.

EXAMPLE 5

98 g (1 mol) of maleic anhydride are dissolved in 60 g (1 mol) of glacial acetic acid while heating to a temperature of from 60° to 70° C. and 269 g (1 mol) of octadecylamine are added to the solution formed in the molten state, the reaction heat generated thereby being maintained between 80° and 90° C.

The following acid number was determined for the crude N-octadecylmaleinamide acid: acid number: calculated: 152.6; acid number: found: 150

The crude N-octadecylmaleinamide acid obtained is introduced while stirring into a mixture of 326.4 g of 27% NaOH in 2736 ml of $H_2O$, 54.72 g of a 4-nonyl-25-AeO addition product, 54.72 g of polyethylene glycol (molar weight 5000 to 6000) and 547 g of sodium salt of the sulfuric acid semiester of glycerine-1,3-bis-2-ethylhexyl ether as 50% aqueous solution and stirring is continued at 90° C. By adding 103.9 g (0.54 mol) of sodium pyrosulfite in a 50% aqueous solution, the mixture is reacted yielding the sulfosuccinic acid amide. After stirring until completion at a temperature of from 80° to 90° C., the pH is adjusted at a value of from 5 to 6 with glacial acetic acid and the final content of the product of the invention is adjusted at 20% with hot water. The finely dispersed emulsion obtained gives an excellent handle while being well storable.

When performing the reaction of tallow fatty amine with an average chain distribution of $C_{14-16}$ and an average molar weight of 270 there is obtained an emulsion being equal in its properties to the above emulsion. The N-tallow fatty alkylamide acid prepared according to the above procedure has an acid number of from 150 to 153, the acid number found was 151. N-coconutfatty alkylamine (average molar weight 200) may be used alternatively instead of N-octadecylamine.

EXAMPLE 6

98 g (1 mol) of maleic anhydride are dissolved in 60 g (1 mol) of glacial acetic acid while heating and 269 g (1 mol) of N-octadecylamine are added to the solution at a temperature of from 80° to 90° C. The N-octadecylmaleinamide acid has an acid number of 151. The crude N-octadecylmaleinamide acid is introduced into a mixture of 326.4 g of 27% NaOH in 2736 ml of $H_2O$, 54.72 g of an addition product of 4-nonylphenol + 25 mols of ethylene oxide, 54.72 g of polyethylene glycol having a molar weight of 4000 and 547 g of sodium salt of the sulfuric acid semiester of glycerine-1,3-bis-2-ethylhexyl ether, which has been reacted with 2 mols of ethylene oxide as 50% aqueous solution, at 90° C., and the mixture is kept at 90° C.

Thereafter 103.9 g (0.54 mol) of sodium pyrosulfite are added. The emulsion obtained in said manner is extremely finely dispersed and very storable.

A product being equal in its properties to the above-mentioned is obtained when replacing the above-described sulfuric acid semiester by an equal quantity of the sodium salt of 2-phosphoric acid ester of 1,3-bis-2-ethxlhexyl-glycerine ether, likewise in the form of a 50% aqueous solution, or by an equal quantity of the 2-phosphoric acid ester of glycerine-1,3-bis-2-ethylhexyl-glycerine ether which has been reacted with 4 mols of ethylene oxide prior to esterifying.

EXAMPLE 7

147 g (1.5 mols) of maleic anhydride are dissolved in 90 g (1.5 mols) of glacial acetic acid while heating to a temperature of from 60° to 70° C. and 403.5 g (1.5 mols) of N-octadecylamine are added to this solution so that the temperature ranges between 80° and 90° C.

An acid number of 153 was determined for the crude N-octadecylmaleinamide acid (theoretical value 153).

The crude N-octadecylmaleinamide acid is introduced into a solution of 489.6 g of 27% NaOH in 4104 ml of $H_2O$, 82 g of 4-nonylphenol, 25 AeO addition product, 82 g of polyethylene glycol having an average molar weight of 8000 and 1314.6 g of the sodium salt of the ethercarboxylic acid which has been obtained by reacting 1,3-bis-isobutyl-glycerine ether with monochloroacetic acid, in the form of a 50% aqueous solution and the reaction mixture is maintained at a temperature of from 80° to 90° C. for a further 3 hours.

Upon reaction with 155 g (0.82 mol) of sodium pyrosulfite there is obtained a particularly storable emulsion. The following glycerine-ether-ether-carboxylic acids may be used in analogous manner:

1,3-di-2-ethylhexylglycerine ether reacted with 3 mols of ethylene oxide and subsequently with monochloroacetic acid, 1,3-di-isobutylglycerine ether reacted with β-chloropropionic acid, or 1-hexyl-3-isobutylglycerine ether reacted with γ-chlorobutyric acid.

EXAMPLE 8

196 g (2 mols) of maleic anhydride are dissolved in 120 g (2 mols) of glacial acetic acid while heating at temperature of from 60° to 70° C. and to the solution obtained there are added 652 g (2 mols) of octadecylpropylene diamine in a way to make the temperature rise to a level between 80° and 90° C. The N-octadecyl-γ-aminopropylmaleinamide acid is introduced into a mixture of 652.8 g of 27% NaOH, 109.4 g of 4-nonylphenol + 30 AeO addition product, 109.4 g of polyethylene glycol having a molar weight of from 5000 to 6000 and 788.8 g of the sodium salt of the sulfuric acid semiester of 1-n-hexyl-3-[2-ethylhexyl]-glycerine ether and stirring is continued for 1 hour at 90° C.

Upon reaction with 207.8 g (1.09 mols) of sodium pyrosulfite as 50% aqueous solution yielding the sulfosuccinic acid amide, stirring at room temperature and adjustment at a pH of 5 with glacial acetic acid there is obtained a particularly storable emulsion imparting to textile material an excellent handle. The reaction is observed by iodometric titration of the sulfite content.

At the end of the reaction 0.5% of the sulfite quantity charged are still present in the 20% emulsion.

The above-described N-octyl-γ-aminopropylmaleinamide acid may alternatively be replaced by the reaction products of N-tallow fatty propylene diamine or by N-coconut fatty alkyl propylene with maleic anhydride, which are further reacted with sodium pyrosulfite according to the above conditions. There is obtained an emulsion being equal in its quality to the above-obtained and imparting to textile material the same good handle.

COMPARATIVE EXAMPLES 98 g (1 mol) of maleic anhydride are dissolved in 60 g (1 mol) of glacial acetic acid while heating to a temperature of from 60° to 70° C. and thereafter 269 g (1 mol) of octadecylamine are added to the solution in a way to maintain the reaction temperature in the range of from 80° to 90° C. The following acid numbers were determined for the crude N-octadecylmaleinamide acid:acid number calculated: 152.6; acid number found: 153

The crude N—octadecylmaleinamide acid obtained is given into 326.4 g of 27% NaOH having a temperature of 90° C. and thereafter it is further reacted with 103.9 g (0.54 mol) of sodium pyrosulfite as 50% aqueous solution yielding the sulfosuccinic acid amide.

After stirring to room temperature, the pH is adjusted to 5 with glacial acetic acid.

The emulsion obtained has only a very low thermal storability (storage for 2 to 3 days at 50° C.) and when applied onto textile fabrics no softening property, whereas the emulsions according to the invention according to Examples 1 to 4 are storable over a period of time or more than 9 to 10 days at 50° C.

98 g (1 mol) of maleic anhydride are dissolved in 60 g (1 mol) of glacial acetic acid while heating and 269 g (1 mol) of octadecylamine are added to the solution in a way to maintain the reaction temperature in the range of from 80° to 90° C. The crude N-octadecylmaleinamide acid has an acid number of 153 (theoretical value 152.6). It is introduced while stirring into a mixture of 326.4 g of 27% NaOH in 2736 ml of $H_2O$, 54.72 g of 4-nonylphenol 25 AeO addition product, 54.72 g of polyethylene glycol having a molar weight of 6000 and 452.1 g of the sodium salt of a $C_{12-18}$alkanesulfonic acid as approximately 60% solution.

Upon reaction with 103.9 g (0.54 mol) of sodium pyrosulfite yielding the sulfosuccinic acid amide, the reaction product is cooled to room temperature and thereafter its pH is adjusted to 5 with glacial acetic acid.

When adjusting the emulsion obtained to the same content of active matter as that of the emulsions of the above Examples 5 to 8, the textile material which has been finished therewith has a considerably harsh feeling and the emulsion has only a very low storability.

What is claimed is:

1. Conditioning agents in the form of aqueous emulsions containing (a) of from 5 to 20, preferably 5 to 15, % by weight of a compound of the formula I

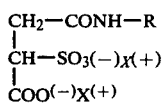

I, wherein R is a branched or linear alkyl or alkylene group having of from 10 to 30, preferably of from 12 to 20, carbon atoms or a group of the formula $R'—NH—(CH_2)_n—$, n is an integer of from 2 to 4, X is a sodium, potassium or ammonium ion and R' is defined as R;

(b) of from 2 to 20, preferably of from 3 to 15, % by weight, of a fatty acid amide sulfate of the formula II

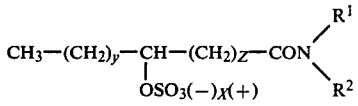

II, wherein $R^1$ and $R^2$ each is an alkyl group having of from 1 to 5 carbon atoms or $R^1$ is a hydrogen atom and $R^2$ is a $C_{1-8}$alkyl, phenyl or $C_{1-4}$alkylphenyl group, Y and Z each is an integer of from 6 to 8, preferably represent together 14, and X is defined as in formula I or, of from 2 to 20% by weight of a glycerine ether derivative of the formula III

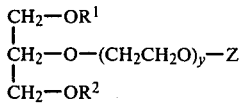

III wherein $R^1$ and $R^2$ represent identical or different, branched or linear $C_{4-8}$alkyl groups, preferably branched $C_8$alkyl groups, Y is zero or an integer of from 1 to 4 and Z is a group of the formulae $-(CH_2)_n-COOMe$, $-SO_3Me_2$ or $-PO_3Me_3$, n is 1, 2 or 3 and Me is an alkali metal, ammonium or trialkylammonium ion;

(c) of from 1 to 15, preferably of from 1 to 3, % by weight, of a polyethylene glycol of the formula IV $$HO(CH_2CH_2O)_mH \quad \text{IV}$$

wherein m is an integer of from 100 to 400, preferably of from 100 to 250 and (d) of from 1 to 5, preferably of from 1 to 3, % by weight of a non ionic ethylene oxide addition product, as emulsifier.

2. Process for conditioning textile material, which comprises treating the textile material with an emulsion as claimed in claim 1.

* * * * *